US006878892B2

(12) United States Patent
Miyako et al.

(10) Patent No.: US 6,878,892 B2
(45) Date of Patent: Apr. 12, 2005

(54) SWITCH-DEVICE SHEET

(75) Inventors: Mamoru Miyako, Aichi (JP); Keiji Nagaya, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 10/463,386

(22) Filed: Jun. 18, 2003

(65) Prior Publication Data

US 2003/0234168 A1 Dec. 25, 2003

(30) Foreign Application Priority Data

| | | |
|---|---|---|
| Jun. 19, 2002 | (JP) | P.2002-178459 |
| Sep. 5, 2002 | (JP) | P.2002-259928 |
| Sep. 5, 2002 | (JP) | P.2002-259929 |
| Dec. 10, 2002 | (JP) | P.2002-357916 |

(51) Int. Cl.[7] ..... H01H 9/00
(52) U.S. Cl. ..... 200/310; 200/314
(58) Field of Search ..... 200/310, 313, 200/314, 317; 345/168, 170; 400/490–496; 362/278, 560, 551, 26; 385/16

(56) References Cited

U.S. PATENT DOCUMENTS

| | | | | |
|---|---|---|---|---|
| 6,045,233 A | * | 4/2000 | Iwai et al. | 362/26 |
| 6,084,190 A | * | 7/2000 | Kenmochi | 200/341 |
| 6,467,924 B2 | * | 10/2002 | Shipman | 362/31 |
| 6,561,660 B2 | * | 5/2003 | Huang | 362/27 |

FOREIGN PATENT DOCUMENTS

| | | | |
|---|---|---|---|
| DE | 3522717 | * 10/1986 | |
| JP | 05337674 | * 6/1992 | 219/121.78 |
| JP | 5-11117 | 1/1993 | |
| JP | 2001067145 | * 3/2001 | |
| JP | 2004055396 | * 7/2002 | |

* cited by examiner

*Primary Examiner*—Elvin Enad
*Assistant Examiner*—Lisa Klaus
(74) *Attorney, Agent, or Firm*—Morgan, Lewis & Bockius LLP

(57) ABSTRACT

A switch-device sheet comprising: a soft and elastic sheet body (5) having operation parts (5*a*) for operating contacts of a switch device; and a light guiding member (6) containing an optical fiber and being partially or completely embedded and wired in the sheet body (5), the light guiding member receiving light at one end (6*a*) and emitting light at the other end (6*b*). Therefore, the whole of the switch-device sheet (4) is flexible, and further the light guiding member (6) may be wired, as desired, outside or in the sheet body (5), while allowing for the size and wiring configuration.

2 Claims, 9 Drawing Sheets

SWITCH-DEVICE SHEET

BACKGROUND OF THE INVENTION

The present invention relates to a switch-device sheet in which a light guiding member is provided on a soft and elastic sheet body having operation parts.

In a conventional vehicular switch device, for example, a light guiding member is installed on a soft and elastic sheet body which is made of, for example, silicone rubber, and has an operation part (contact operation part) for operating switch contacts.

The light guiding member is generally formed with a transparent and hard synthetic resin block, and is embedded in the sheet body. A light emitting body is located just under or near the light guiding member. The light guiding member receives light emitted from the light emitting body at one end, and emits the light at the other end, and operation knobs of the switch device, the display section, or the like are illuminated.

In the conventional switch device, the sheet body is soft and elastic, but the light guiding member is formed with the hard synthetic resin block. Therefore, the resultant switch-device sheet is not flexible as a whole. Accordingly, a place to attach the switch-device sheet is limited to a flat plane portion, while avoiding a curved portion.

The light guiding member of the hard synthetic resin block is not flexible in design also of its size and configuration. Accordingly, a light emitting position on the other end of the light guiding member in the sheet body is limited in its selection by the size and configuration of the light guiding member. Additionally, the distance between the light emitting body and the operation knob is also limited in its selection by the size and configuration of the light guiding member.

Further, the conventional switch device is known, which includes a light source, such as a light emitting diode or a bulb, to illuminate a display section presenting the contents on operations of the light guiding device, and a light guiding member for guiding light emitted from the light source to the display section.

The light guiding member is made of a material of a high optical transmittance, such as acrylic resin.

Incidentally, there is a light transmission plate in which a light diffusion layer is provided on the reverse side of a transparent light guiding member (see JP-A-05-11117, for example), although it has no direct relation to the problem to be solved by the present invention.

In a device having the conventional light guiding member, light passing through the light guiding member leaks from a surface of the light guiding member parallel to the light guiding direction since the light is scattered inside the light guiding member. For this reason, the optical directivity of the light guiding member is not good, and the illumination efficiency is not satisfactory in illuminating the display section with light emitted from the light source.

In further another conventional vehicular switch device, a light guiding member is installed on a soft and elastic sheet body which is made of, for example, silicone rubber, and has an operation part (contact operation part) for operating switch contacts. In this switch device, the light guiding member may be handled together with the sheet body. Accordingly, the switch device is excellent in its assembling.

The light guiding member of the switch device is formed with a transparent and hard synthetic resin block, such as acrylic resin. And it is embedded in the sheet body. A light emitting body is located just under or near one end of the light guiding member. The light guiding member receives light emitted from the light emitting body at one end and guides the light, and emits the light at the other end. The guided light illuminates operation knobs of the switch device, the display section, or the like.

In the conventional switch device in which the sheet body contains the light guiding member, the sheet body is soft and elastic, but the light guiding member is formed with the hard synthetic resin block. Therefore, the whole of the resultant switch-device sheet is not flexible. Accordingly, a place to attach the switch-device sheet is limited to a flat plane portion, while avoiding a curved portion.

SUMMARY OF THE INVENTION

Accordingly, an object of the present invention is to a switch-device sheet which may be attached not only to the flat plane portion but also the curved portion, and enables one to select, as desired, the light emitting position on the other end of the light guiding member and the distance between the light emitting body and the operation knob.

Another object of the present invention is to provided a light guiding device which is capable of improving the optional directivity and the illumination efficiency of a light guiding member.

In order to solve the aforesaid object, the invention is characterized by having the following arrangement.

A switch-device sheet comprising:

a soft and elastic sheet body including an operation part for operating contact of a switch device; and a light guiding member including an optical fiber and being embedded and wired in the sheet body, the light guiding member receiving light at one end thereof and emitting light at the other end.

The switch-device sheet according to the aspect 1, wherein the optical fibers includes a core coated with a coating, and a part of the coating is removed from the core at the other end of the light guiding member by grinding, and light is emitted from the coating removed part of the light guiding member.

The switch-device sheet according to the aspect 1, wherein the light guiding member includes a plurality of the optical fibers, and the plurality of optical fibers are bonded together, except at least one portion of the light guiding member to be bent.

The switch-device sheet according to the aspect 1, wherin the light guiding member is formed so that a plurality of the optical fibers-are arranged into a strip-form and bonded together, and in this state, is branched out into plural sections by tearing the bonded optical fibers.

The switch-device sheet according to the aspect 1, wherein a surface of the light guiding member is painted white or metallic tone.

The switch-device sheet according to the aspect 1, wherein a light guiding member is partially embedded in the sheet body.

The switch-device sheet according to the aspect 1, wherein a light guiding member is completely embedded in the sheet body.

A light guiding device comprising:

a light guiding member made of a soft and elastic material of a high optical transmittance, a light being transmitted from one end of the light guiding member to the other end of the light guide member in a guiding direction; and a reflecting member including a reflecting surface colored to have a color of a high reflectivity, wherein the reflecting surface is pressed against a surface of the light guiding member which is substantially parallel to the guiding direction.

The light guiding device according to the aspect 8, wherein the light guiding member is attached to a contact sheet including a operation part, the reflecting member serves as a substrate including contact, and when the contact sheet is coupled to the substrate so as to face the operation part to the contact, the reflecting surface is pressed against the surface of the light guiding member.

A switch-device sheet comprising:

a sheet body being made of a soft and elastic material and including operation parts for operating contacts of a switch device; and a light guiding member made of a soft and elastic material of a high optical transmittance, the light guiding member being integral with the sheet body and forming a light guiding path in the sheet body.

The switch-device sheet according to the aspect 10, wherein the light guiding member is embedded in the sheet body.

The switch-device sheet-according to the aspect 10, wherein the light guiding member is exposed to an exterior from the sheet body.

DETAILED DESCRIPTION OF PREFERRED EMBODIMENTS

First Embodiment

A first embodiment according to the present invention will be described with reference to FIGS. 1 and 2.

Figure 1:
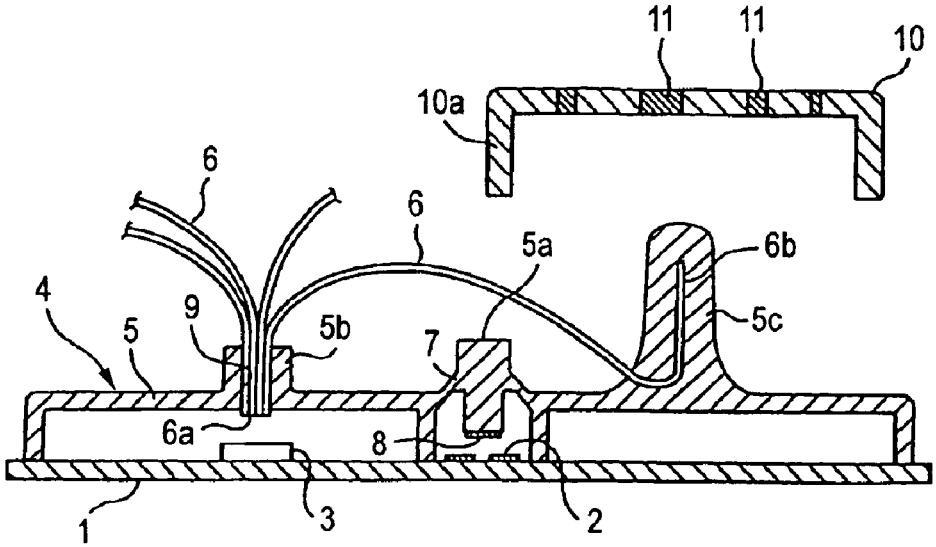
FIG. 1 is a longitudinal sectional view showing an overall switch device which is a first embodiment of the invention.

Firstly, in FIG. 1 showing an overall construction of a switch device, especially, a vehicular switch device, reference numeral 1 designates an insulating substrate. In this instance, electric parts, such as fixed contacts 2 and a light emitting body 3, are provided on the insulating substrate 1. The pair of fixed contacts 2 is disposed while being spaced from each other by a distance necessary for insulation. A light emitting diode or an electric bulb is used for the light emitting body 3.

Figure 2:
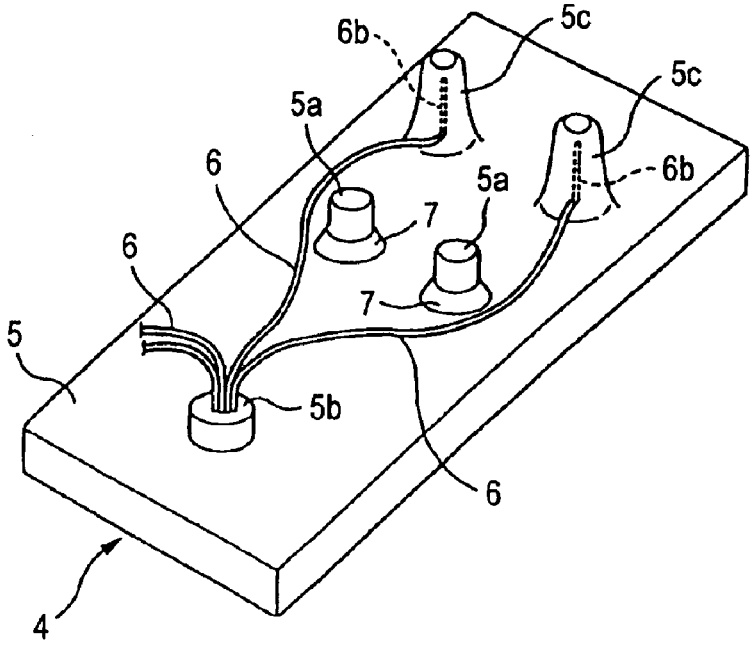
FIG. 2 is a perspective view showing a single switch-device sheet.

A sheet 4 for the switch device (The sheet will be referred to as a switch-device sheet), as shown also in FIG. 2, includes a sheet body 5 and light guiding members 6. The sheet body 5 is made of a soft and elastic material, such as silicone rubber, which is semitransparent, e.g., milky-white, and has a translucency. The sheet body 5 may be made of a material which is transparent and has a translucency, such as soft acrylic resin, in place of the silicone rubber.

Two operation parts 5*a* are disposed on the central portion of the sheet body 5. A first fiber embedding part 5*b* is formed on the left side of the operation parts, while two second fiber embedding parts 5*c* are formed on the right side. The operation parts 5*a* are cylindrical parts higher than the remaining upper surface of the sheet body 5. A periphery of each operation part is connected to the remaining part of the sheet body 5 by a thin part 7. With this structure, the operation part is elastically displaceable in the vertical directions in the figure. As shown in FIG. 1, a movable contact 8 is provided on a lower surface of each operation part 5*a*, while corresponding to each pair of fixed contacts 2.

The first fiber embedding part 5*b* includes a raised part of a height substantially equal to that of the operation parts 5*a*. A fiber insertion hole 9 vertically passes through a central part of the first fiber embedding part. The second fiber embedding parts 5*c* are raised parts higher than the operation parts 5*a*.

The light guiding members 6 are optical fibers as linear members each containing mainly acrylic resin, for example, and are flexible. A necessary number of light guiding members 6 are used. All of one ends 6*a* of the light guiding members are press fit into and embedded in the fiber insertion hole 9 of the first fiber embedding part 5*b*.

Of the other ends 6*b* of the light guiding members 6, those corresponding to the second fiber embedding parts 5*c* are embedded in the second fiber embedding parts 5*c* in advance and, in this state, those are molded, viz., insert-molded. The remaining other ends 6*b* of the light guiding members 6 are put in a free state so as to be adaptable to other guided light destinations, for example.

In this case, the middle portions of the light guiding members each between one end 6*a* and the other end 6*b* of the light guiding members 6 are wired outside the sheet body 5 (above the sheet body in the figure).

The sheet 4 thus constructed is applied and coupled to the insulating substrate 1. Therefore, the movable contact 8 (operation parts 5*a*) faces the fixed contacts 2, and one end group of the light guiding members 6 (second fiber embedding parts 5*c*) face the light emitting body 3.

An operation knob 10 is disposed above the first fiber embedding part 5*b*, and the operation knob 10 is, for example, a push button having light transmitting parts 11. One end 10*a* of the operation knob 10 is located above the operation parts 5*a*. Accordingly, when an operator depresses the operation knob 10, the operation part 5*a* is depressed by the one end 10*a* of the operation knob 10 through a pusher (not shown). The depressed operation part 5*a* causes the movable contact 8 to contact with the fixed contacts 2, whereby those contacts are electrically connected to each other. The operation parts 5*a* function as members to operate the contacts of the switch device.

Light emitted by the light emitting body 3 is led from the one end 6*a* of each light guiding member 6 to the other end 6*b* through the corresponding light guiding member 6. The light is then emitted through the second fiber embedding parts 5*c* of the sheet body 5 having a translucency, and illuminates the light transmitting parts 11 of the operation knob 10.

Thus, the switch-device sheet 4 thus constructed includes the sheet body 5 as a soft and elastic member having operation parts 5*a* for operating the contacts of the switch device, and the light guiding members 6, as optical fibers, of which both ends 6*a* and 6*b* as parts of them are embedded and wired, and thus the one end 6*a* receives light and the other end 6*b* emits light.

The optical fibers (light guiding members 6) are linear members, and flexible. Accordingly, with the soft and elastic feature of the sheet body 5, the whole switch-device sheet 4 is flexible. The switch-device sheet may be attached not only to the flat plane portion but also to the curved portion, while in the conventional switch device, the portion to attach the switch-device sheet is limited only to the flat plane portion.

The optical fibers (light guiding members 6) as flexible linear members can be wired, as desired, outside the sheet body 5, while allowing for the size and wiring configuration. Accordingly, the light emitting positions of the other ends 6*b* of the light guiding members 6 and the distance between the light emitting body 3 and the operation knob 10 can be selected, as desired, without any limitation by the size and configuration of the light guiding members 6.

Not only the ends 6*a* and 6*b* of the light guiding members 6 but also the whole of the light guiding members 6 may be embedded and wired in the sheet body 5 by insert molding process. Even if so constructed, the whole switch-device sheet 4 is flexible, and the light guiding members 6 can be wired, as desired, in the sheet body 5, while allowing for the dimensions and wiring configuration. Accordingly, the advantages similar to those mentioned above can be obtained.

The tips of the other ends 6*b* of the light guiding members 6 may be exposed from the sheet body 5 and light is emitted from the exposed tips of the other ends.

Second Embodiment

FIGS. 3 through 7 show a second embodiment of the invention. Description will be given about only the differences of the second embodiment from the first embodiment.

Figure 3:
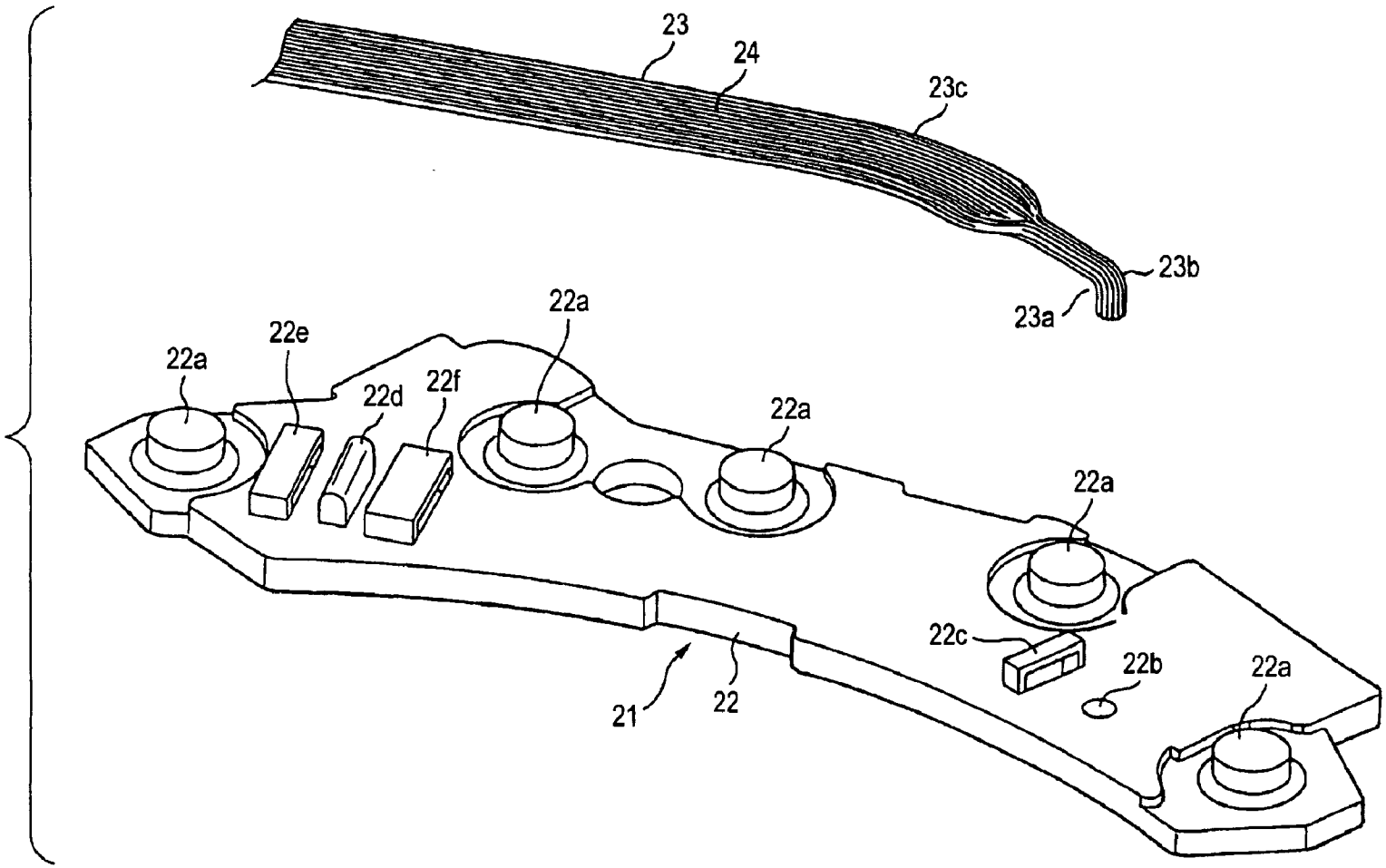
FIG. 3 is a perspective view showing a switch device which is a second embodiment of the invention.
Figure 4:
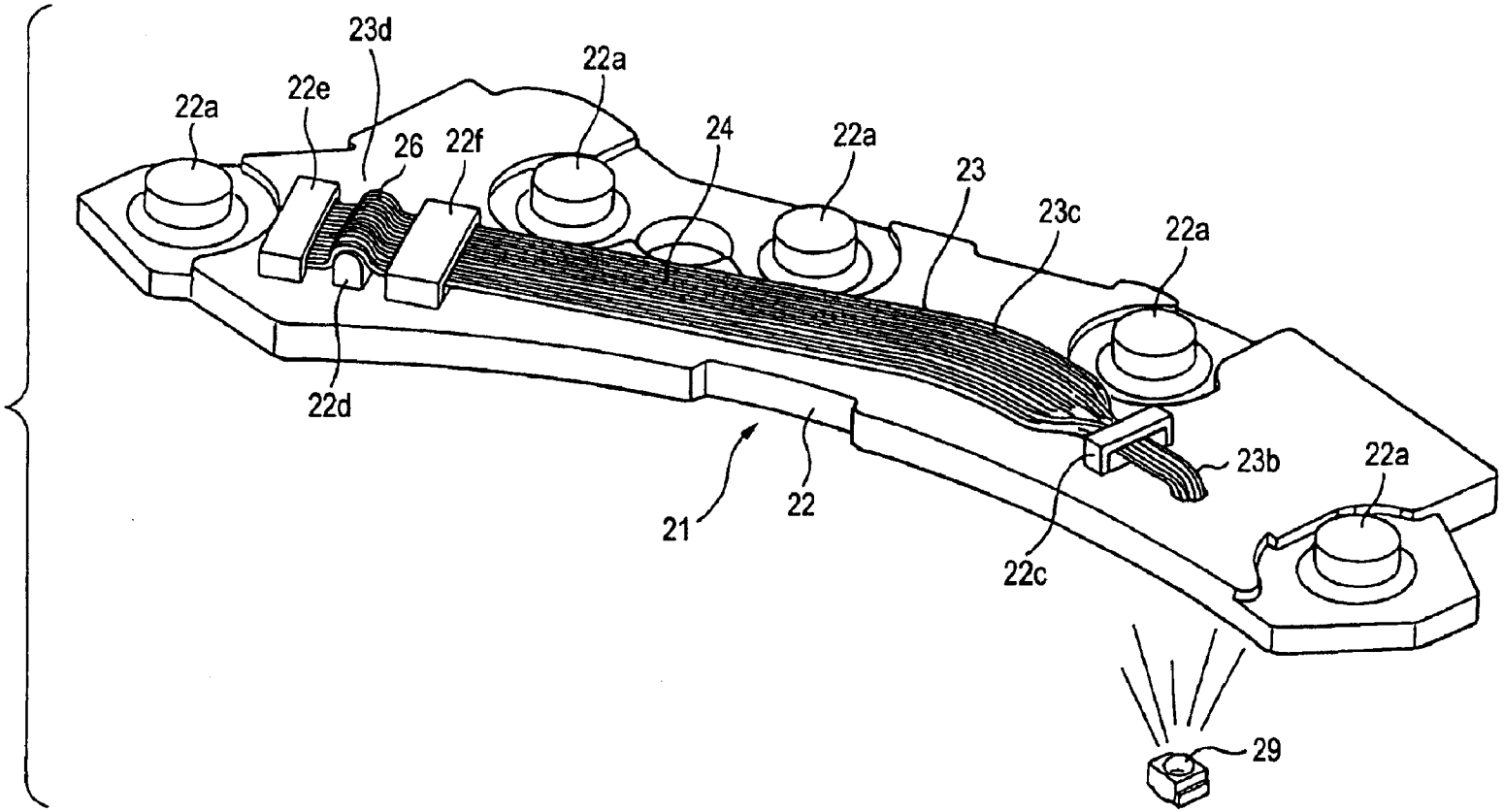
FIG. 4 is a partial perspective view showing the switch device of the second embodiment.

In the second embodiment, as shown in FIGS. 3 and 4, a sheet body 22 of a switch-device sheet 21 is made of a soft and elastic material, such as a silicone rubber, as in the case of the sheet body 5. Operation parts 22*a* are provided at plural positions (5 positions, for example) dispersedly laid out over the entire surface of the switch-device sheet, as in the case of the operation parts 5*a*. An embedding hole 22*b* is formed in a right end part of the sheet body 22. A holder part 22*c*, shaped like a reversed U, is provided near (on the left side in the figure) the embedding hole 22*b*. A semicylinrdical-shape part 22*d* is provided at a position in a left end part of the sheet body 22. Holder parts 22*e* and 22*f*, each shaped like a reversed U, are formed on both sides of the protruded part 22*d*.

Figure 5:
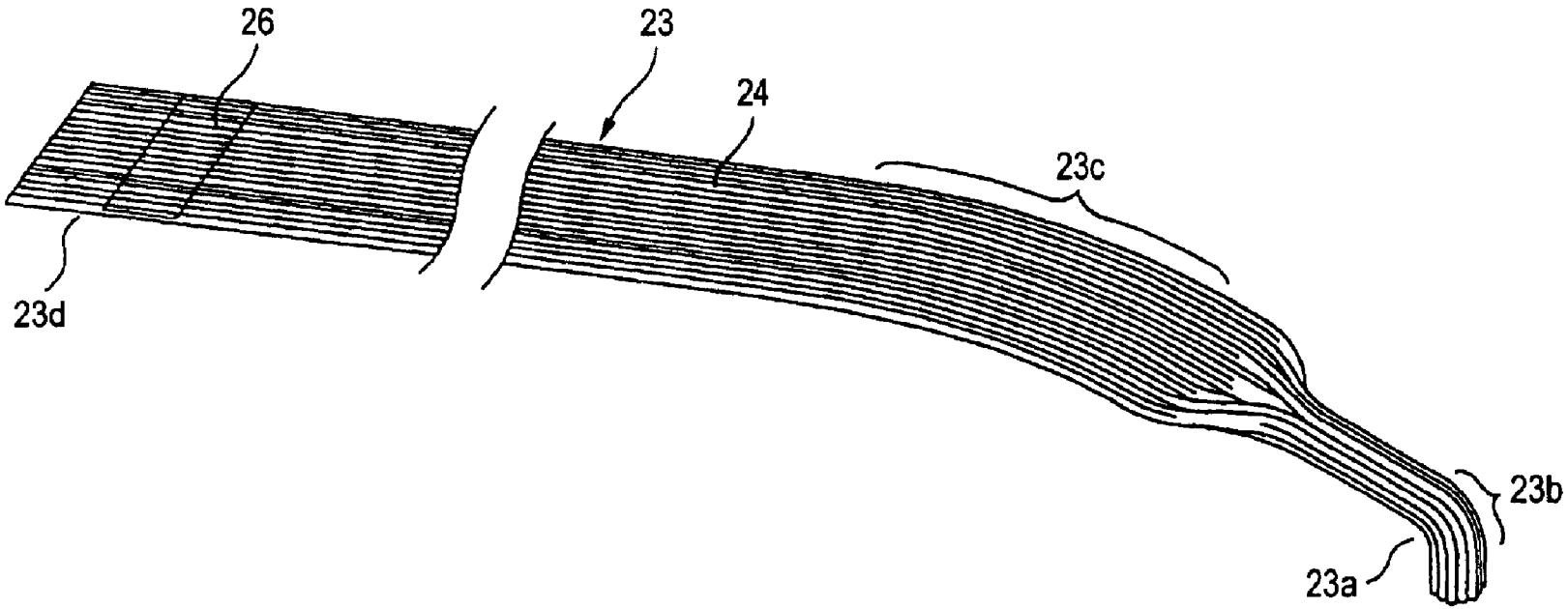
FIG. 5 is a perspective view showing a single switch-device sheet.
Figure 6:
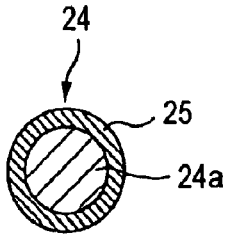
FIG. 6 is a longitudinal sectional view showing a single optical fiber.

A light guiding member 23, as shown also in FIG. 5, is formed with a plurality of optical fibers 24, which are similar to the optical fibers of the light guiding members 6 already described. In each optical fiber 24, as shown in FIG. 6, a core 24*a* is coated with a coating 25. An optical refractive index of the coating 25 is small, while that of the core 24*a* is large. Light passing through the core 24*a* is totally reflected at an interface between the coating and the core 24*a*.

The light guiding member 23 is preferably constructed such that the optical fibers 24 are arranged into a strip form shown in FIG. 5, and are bonded together by adhesive. In this case, those optical fibers 24 are gathered into a cylindrical form at the right end (one end) 23*a* of the light guiding member 23, and are bonded together thereat except a part 23*b*. The part 23*b* of the light guiding member is bent to have a reversed L shape, as will be described later. Thus, the optical fibers of the light guiding member 23 are bonded together thereat except the bent part 23*b*.

The optical fibers 24 of the light guiding member 23 are not bonded also at a part 23*c* near the right end 23*a*, and are gently bent in a state that those fibers are arranged to be flat, as will be described later. Accordingly, the optical fibers of the light guiding member 23 are not bonded also at the bent part 23*c*.

Figure 7:
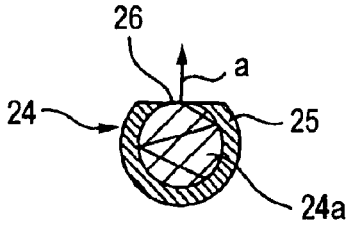
FIG. 7 is a longitudinal sectional view showing a single optical fiber at a light emitting part.

At the left end (the other end) 23*d* of the light guiding member 23, only an upper part of the coating 25 of the optical fibers 24 is cut out by grinding as shown in FIG. 7 to thereby form a light emitting part 26.

With such a construction, the one end 23*a* of the light guiding member 23 is passed through the holder part 22*c*, and is bent at the part 23*b* to be shaped like L, and inserted into and embedded in the embedding hole 22*b* of the sheet body 22. The other end 23*d* of the light guiding member 23 is passed through the holder part 22*f*, led along the protruded part 22*d*, and passed through the holder part 22*e* and fixed thereto. At this time, the light emitting part 26 is located on the protruded part 22*d*. A middle part of the light guiding member 23 between the one end 23*a* and the other end part 23*b* is gently bent at the part 23*c* near the one end 23*a*, whereby the middle part is laid on the upper surface of the sheet body 22, while being somewhat bent backward.

The sheet 21 thus constructed is applied and coupled to the insulating substrate. As a result, a movable contact (not shown) provided on the lower side of the operation parts 22*a* faces fixed contacts (not shown) on the insulating substrate. The right end 23*a* of the light guiding member 23, particularly its end face, faces a light emitting body 29 (FIG. 4) on the insulating substrate.

Therefore, light emitted from the light emitting body 29 is led from the one end 23*a* of the light guiding member 23 to the other end 23*d* via the light guiding member 23, and is emitted outside from the light emitting part 26 as indicated by an arrow "a" in FIG. 7.

In the switch device thus constructed, the light guiding member 23 is formed with the optical fibers 24 each coated with a coating 25. A part of the coating 25 is removed from the optical fibers at the other end 23*d* of the light guiding member by grinding, and light is emitted from the coating removed part of the light guiding member. Accordingly, it is easy to carry out a process to totally reflect light in the middle part of the light guiding member 23 and a process of emitting light from the other end 23*d* for the illumination.

In this case, the light guiding member 23 is constructed such that the optical fibers 24 forming the light guiding member are bonded together except the parts 23*b* and 23*c* where the optical fibers 24 are bent. Thus, the optical fibers 24 forming the light guiding member 23 are gathered together. Accordingly, the light guiding member is easy to handle. Further, in the bending parts 23*b* and 23*c*, the optical fibers 24 are not bonded together. This feature eliminates the increase of a rigidity of the light guiding member, and hence, provides an easy bending of the same.

In this case, only either of the parts 23*b* and 23*c* of the light guiding member 23, especially only the parts 23*c* which is difficult to be bent may not be bonded (For this reason, the light emitting part 26 and the portions on both sides of the light emitting part as other bending portions of the light guiding member 23 are bonded together). Accordingly, it suffices that the optical fibers of the light guiding member, except at least one portion thereof to be bent, are bonded together.

Third Embodiment

Figure 8:
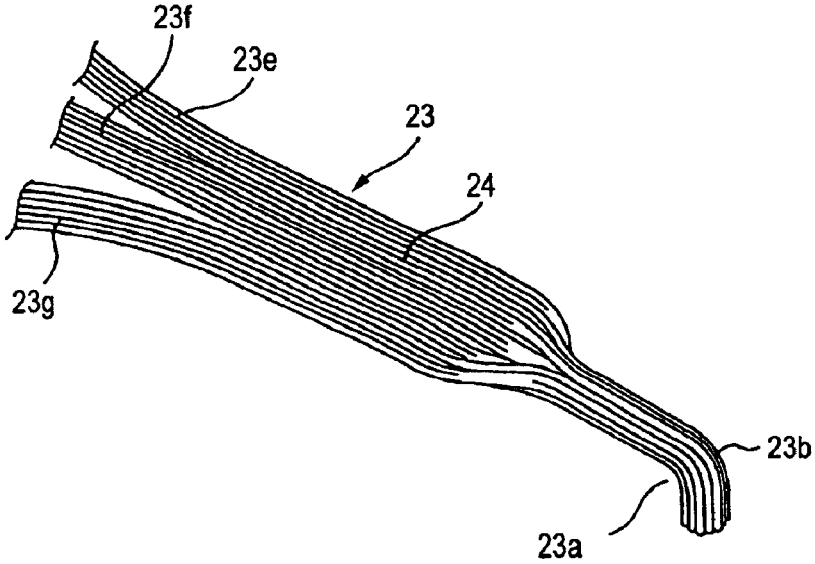
FIG. 8 is a perspective view showing a portion corresponding to that of FIG. 5 in a third embodiment of the invention.

FIG. 8 shows a third embodiment of the invention. Description will be given about only the differences of the third embodiment from the second embodiment. In the instant embodiment, the light guiding member 23 is constructed such that the plurality of the optical fibers 24 of the light guiding member 23 are arranged in a strip form, and in this state, bonded together. The light guiding member 23 thus constructed is branched out into plural, for example, three, sections 23*e*, 23*f* and 23*g* at the other end 23*d*, by tearing the light guiding member at the other end 23*d* into the corresponding number of fragmental section.

In the switch device of the instant embodiment, in a case where a plurality of destinations for which light emitted from the light guiding member 23 is destined are present, light from the light guiding member may easily be branched out for those emitted light destinations by merely tearing the light guiding member 23.

It should be understood that the invention is not limited to those illustrated embodiments, but may variously be modified, altered, and changed within the true spirits of the invention.

As described above, the switch-device sheet may be attached not only to the flat plane portion but also to the curved portion, while in the conventional switch device, the portion to attach the switch-device sheet is limited only to the flat plane portion. Accordingly, the light emitting positions of the other ends of the light guiding members and the distance between the light emitting body and the operation knob may be selected, as desired.

Fourth Embodiment

Figure 10:
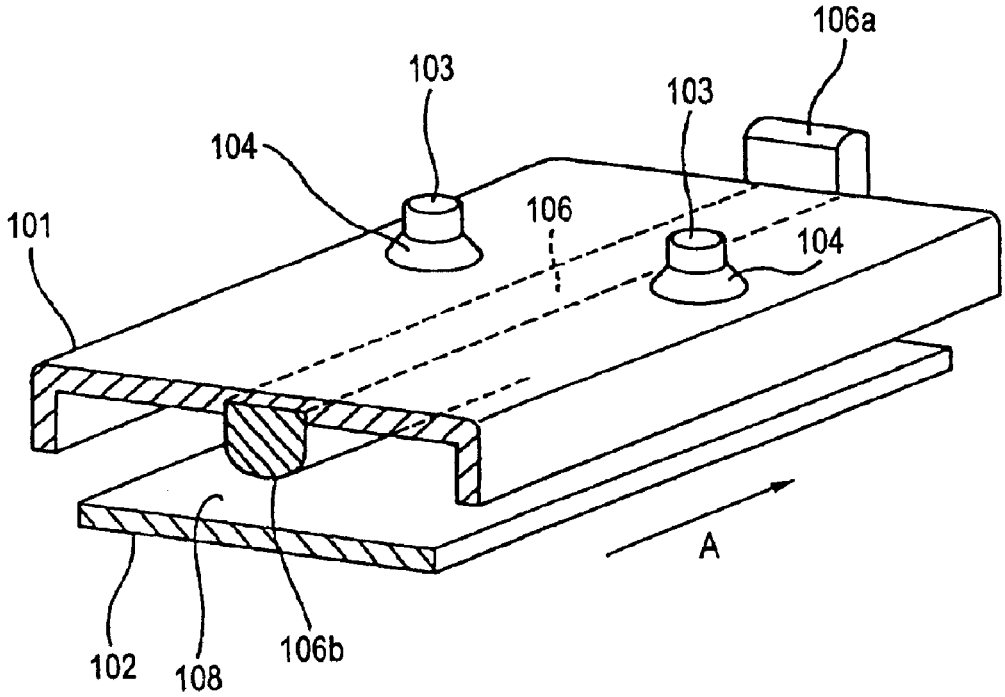
FIG. 10 is a broken exploded perspective view showing an overall construction of the fourth embodiment.
Figure 11:
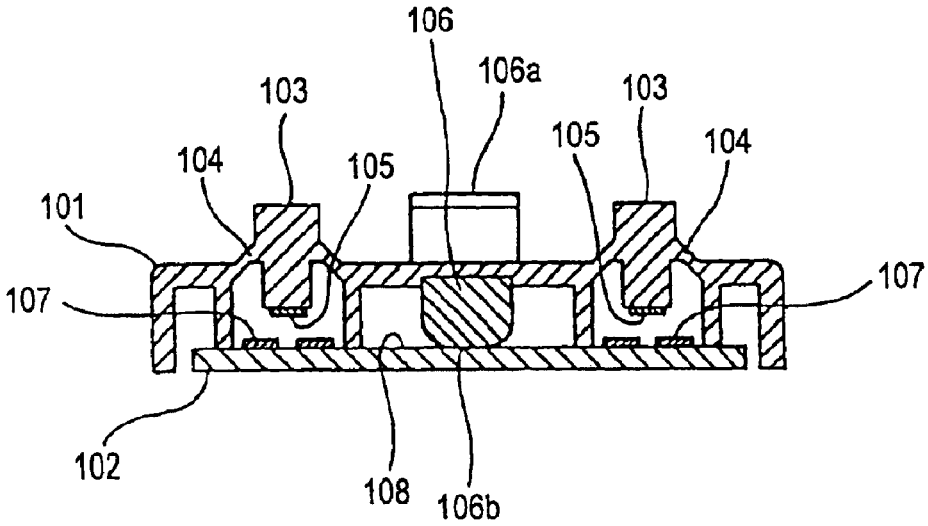
FIG. 11 is a longitudinal sectional view showing an overall construction of the light guiding device.

A fourth embodiment of the invention will be described with reference to FIGS. 9 to 11.

Figure 9:
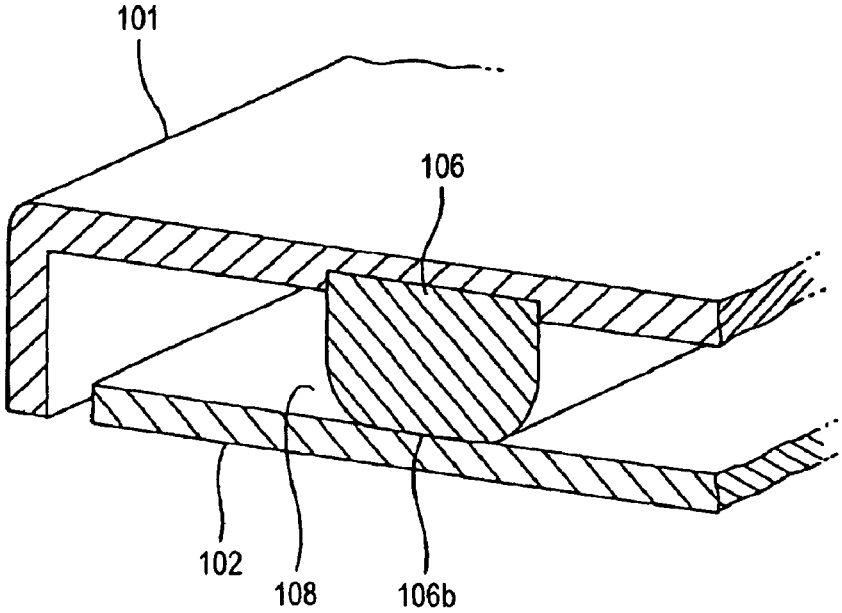
FIG. 9 is a broken perspective view showing a major portion of a fourth embodiment to the invention.

Firstly, in FIG. 9, there is shown a contact sheet 101 and an insulating substrate 102 in a switch device, especially, a vehicular switch device. The contact sheet 101 is made of a material, such as silicone rubber, and the material is opaque, e.g., white or black, and is low in optical transmittance.

A plurality of operation parts 103 (two in this instance) are disposed on the contact sheet 101. The operation parts 103, as shown in FIG. 11, are each cylindrical part higher than the remaining upper surface of the contact sheet 1. A periphery of each operation part is connected to the remaining part of the contact sheet 101 by a thin part 104. A movable contact 105 is provided on a lower surface of each operation part 103.

A light guiding member 106 is mounted on the reverse side of the contact sheet 101. Accordingly, the contact sheet 101 serves as a base member to mount the light guiding member 106. The light guiding member 106 is made of a soft and elastic material of a high optical transmittance, such as transparent silicone rubber, soft silicone resin, and soft acrylic resin. In this instance, the light guiding member 106 is long and shaped like a semicircular roof as shown in FIG. 10. The light guiding member, while its flat surface is directed upward, is brought into close contact with the rear surface of the contact sheet 101 and fixed thereon by integral molding, adhesive, or the like, in such a way that it partially bites into the contact sheet 101. Further, in this case, the light guiding member 106 is disposed such that one end (not shown) thereof is directed downward on the rear side of the contact sheet 101, and the other end 106*a* thereof is protruded upward from the contact sheet 101.

The insulating substrate 102 is formed with a circuit board, for example. Electric parts, such as two pairs of fixed contacts 107 shown in FIG. 11, are provided on the upper surface of the insulating substrate 102. Each pair of the fixed contacts 107 are disposed while being spaced from each other by a distance necessary for insulation. A light source, such as a light emitting diode or an electric bulb, both not shown, is additionally provided on the insulating substrate 102.

The upper surface of the insulating substrate 102 serves as a reflecting surface 108 of a high reflectivity. The reflecting surface 108 is formed such that the whole insulating substrate 102 is made of a reflecting colorant of white color or that the upper surface of the insulating substrate 102 is colored reflecting color, such as white. For the coloring of the reflecting surface, painting or printing may be used. Particularly for the circuit board, the screen printing or the like may be used. The reflecting color may be silver or the like. In this case, the reflecting surface may by aluminum evaporation.

The contact sheet 101 is placed above the insulating substrate 102 which serves as the reflecting member having the reflecting surface 108, and coupled to the latter. In this case, the lower surface 106*b* parallel the light guiding member 106 is abutted against the light guiding member 106 so as to press it. As a result, the semicircular surface (FIG. 10) of the lower surface 106*b* of the light guiding member 106 is flattened as shown in FIGS. 9 and 11.

The light source faces the one end of the light guiding member 106, and the movable contacts 105 faces the fixed contacts 107. An operation know (not shown) is located above the operation parts 103, with a pusher (also not shown) being interposed therebetween. A display section allowing light to pass therethrough (also not shown), which is for the display on switch operations, is located above the other end 106*a* of the light guiding member 106.

With such a construction, when an operation knob (not shown) is operated, the operation parts 103 are depressed through a pusher (not shown), so that the movable contact 105 comes in contact with the fixed contacts 107, whereby those contacts are electrically continuous.

Light emitted from the light source (not shown) is guided from one end of the light guiding member 106 to the other end thereof, through the light guiding member 106. In this case, the lower surface 106*b* of the light guiding member 106 is a surface parallel to the light guiding direction (arrow A of FIG. 10) of the light guiding member 106. Light led by the light guiding member 106 is emitted upward from the other end 106*a* of the light guiding member 106, and illuminates the display section having a translucency.

While the light is being transmitted through the light guiding member 106, the light is scattered inside the light guide member 106. Thus the light is transmitted not only in a direction along the light guide member 106 but also in a various directions. At this time, the reflecting surface 108 of the insulating substrate 102 as the reflecting member is abutted against the lower surface 106*b* of the light guiding member 106, to thereby thrust down the lower surface. Therefore, since the reflecting surface 108 is in close contact with the lower surface 106*b* of the light guiding member 106, the scattered light toward the insulating substrate 102 is reflected by the reflecting surface 108, to thereby eliminate the leakage of light. In this way, the optical directivity and illumination efficiency of the light guiding member 106 are improved.

Figure 12:
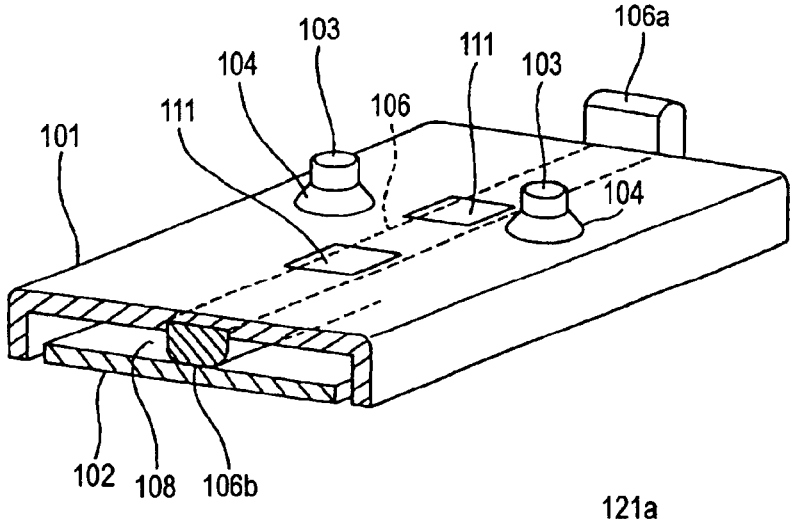
FIG. 12 is a broken exploded perspective view showing an overall construction of a fifth embodiment.
Figure 13:
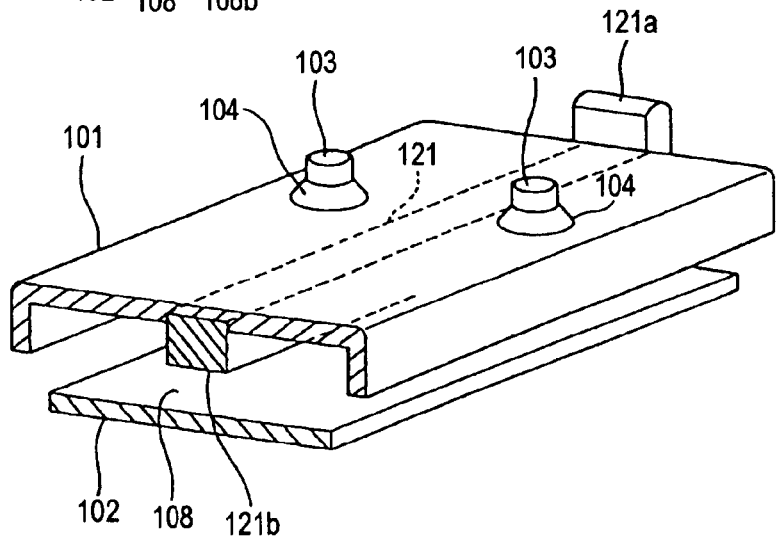
FIG. 13 is a longitudinal sectional view showing a sixth embodiment of the invention.

FIGS. 12 and 13 show fifth and sixth embodiments of the present invention. Like or equivalent portions in those embodiments are designated by like reference numerals in the first embodiment, for simplicity.

Fifth Embodiment

In the fifth embodiment shown in FIG. 12, a plurality of light transmitting parts 111 are formed in a portion of the contact sheet 101 on which the light guiding member 106 is attached. Light guided by the light guiding member 106 is emitted also from the light transmitting parts 11 and illuminates portions other than the display section corresponding to the other end 106*a*.

Sixth Embodiment

Figure 14:
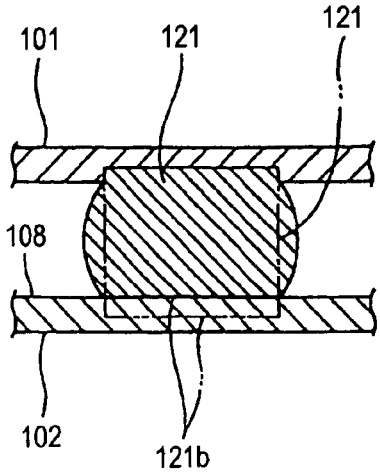
FIG. 14 is a partially enlarged longitudinal sectional view showing the sixth embodiment.

In the sixth embodiment shown in FIGS. 13 and 14, a light guiding member 121, shaped like a square pillar, is used in place of the light guiding member 106. The lower surface 121*b* of the guiding member 121 is abutted against the reflecting surface 108 which is parallel with the light guiding direction of the guide member 121, whereby the reflecting surface presses the lower surface 121*b* of the guiding member 121 (In FIG. 14, a cross-sectional configuration of the light guiding member 121 before it is pressed is indicated by a two-dot-chain line, and after it is pressed is indicated by a solid line.)

Also in this embodiment, the reflecting surface 108 is positioned in close contact with the light guiding member 121, as in the fourth embodiment, whereby no light leakage occurs. As a result, the optical directivity of the light guiding member 106 is improved, and the illumination efficiency is also improved.

It should be understood that the present invention is not limited to the illustrated embodiments, but may variously be modified, altered and changed within the true spirits and scope of the invention. For example, the reflecting member may be a case or the like.

As seen from the foregoing description, advantages of improved optical directivity and illumination efficiency accrue by the light guiding device of the invention.

Seventh Embodiment

A seventh embodiment of the present invention will be described with reference to the accompanying drawings.

Figure 17:
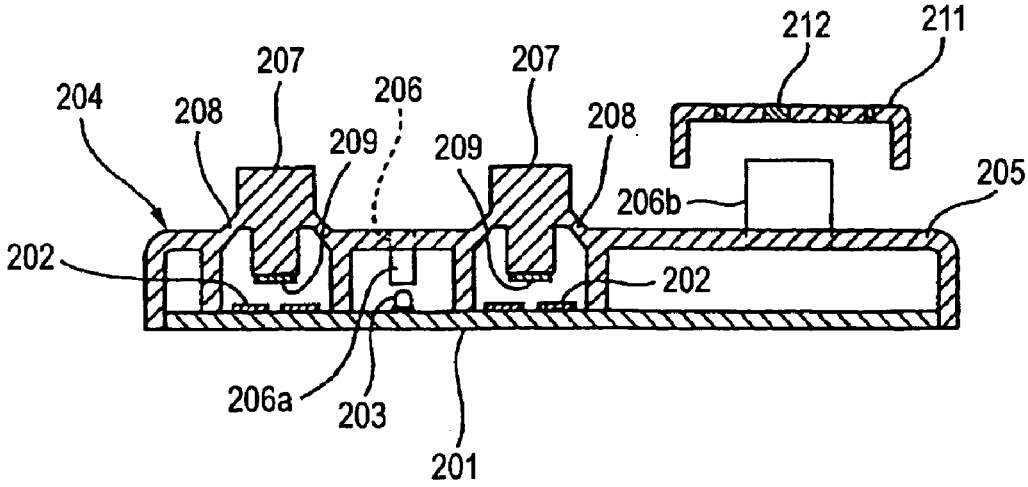
FIG. 17 is a longitudinal sectional view showing an overall switch-device sheet.

Firstly, in FIG. 17, reference numeral 201 designates an insulating substrate, such as a circuit board, used in a switch device, especially, a vehicular switch device. In this instance, electric parts, such as fixed contacts 202 and a light emitting body 203, are provided on the insulating substrate 201. In this instance, each pair of the fixed contacts 202 are disposed while being spaced from each other by a distance necessary for insulation. A light-emitting diode or an electric bulb is used for the light emitting body 203.

Figure 15A:
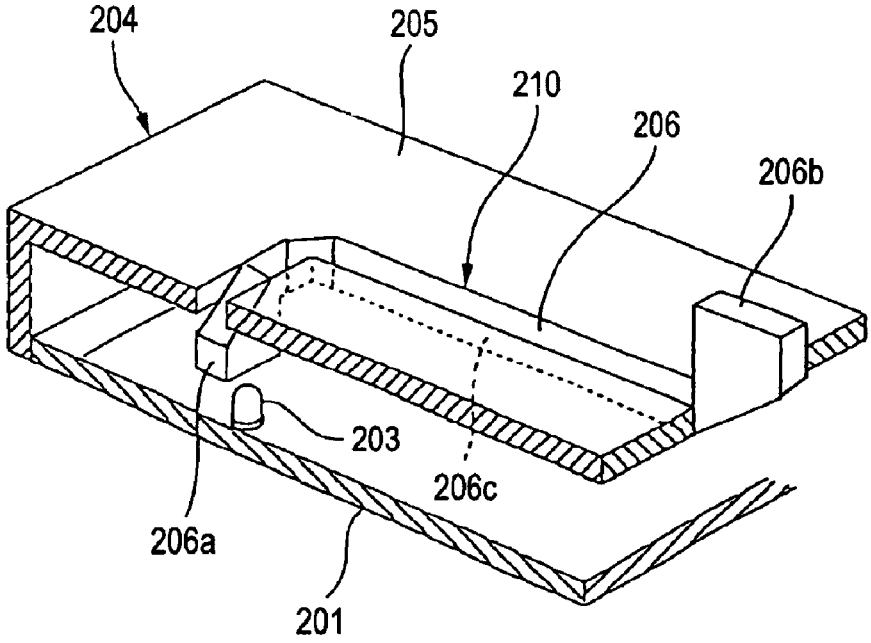
FIG. 15A is a broken perspective view of a major part showing a seventh embodiment of the invention.
Figure 15B:
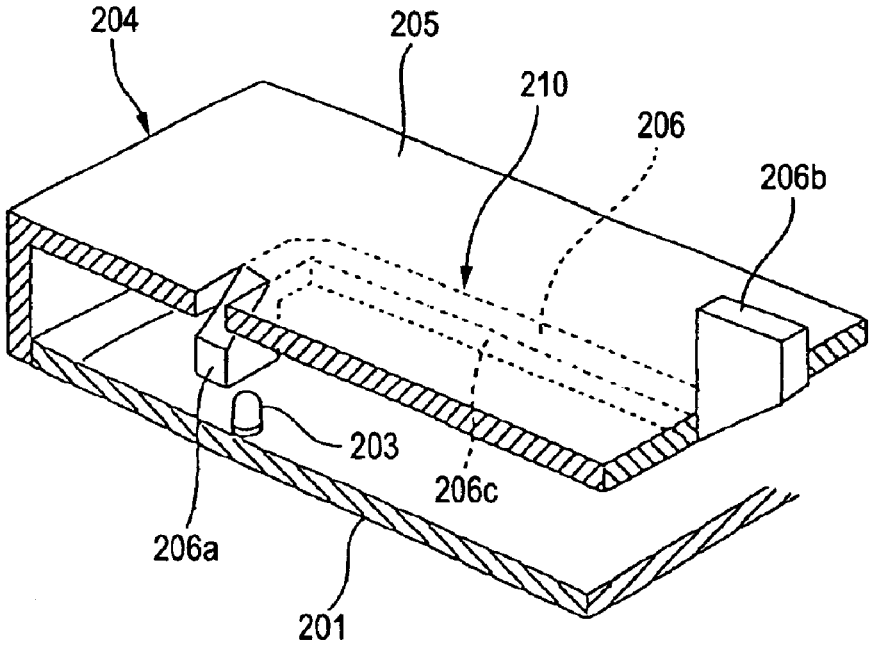
FIG. 15B is a broken perspective view of a major part showing modification of the seventh embodiment of the invention.
Figure 16:
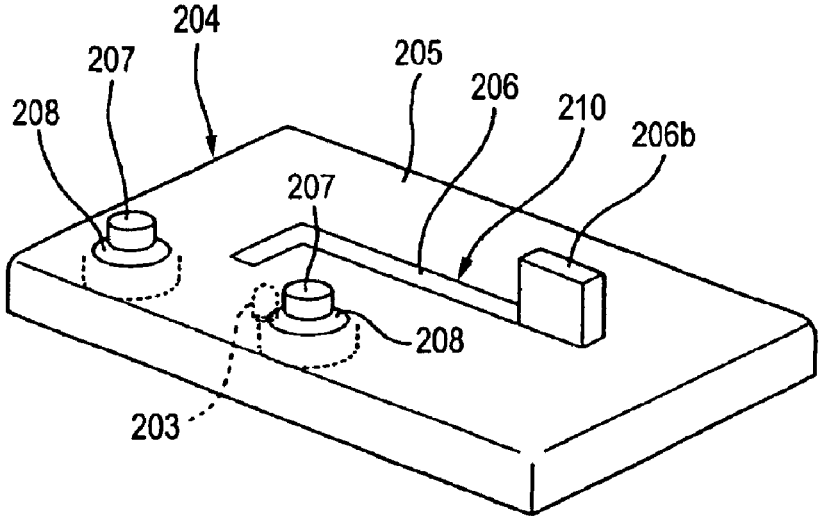
FIG. 16 is a perspective view showing an outward appearance of a switch-device sheet.

A sheet 204 for the switch device, which is disposed on and coupled to the insulating substrate 201, as shown in FIGS. 15A, 15B and 16, includes a sheet body 205 and a light guiding member 206. The sheet body 205 is made of a soft and elastic material, such as silicon rubber, and is opaque, or is colored black, milky-white, or white.

On the sheet body 205, operation parts 207 are formed at positions opposed to those paired fixed contacts 202, as shown in FIG. 17. The operation parts 207 are cylindrical parts higher than the remaining upper surface of the sheet body 205. A periphery of each operation part is connected to the remaining part of the sheet body 205 by a thin part 208. With this structure, the operation part is elastically displaceable in the vertical directions in the figure.

A movable contact 209 is provided on a lower surface of each operation part 207, while corresponding to each pair of fixed contacts 202. When the operation parts 207 are depressed, the movable contact 209 comes in contact with the corresponding paired fixed contacts 202, whereby those are electrically continuous to each other. The operation parts 207 function as members to operate the contacts of the switch device.

The light guiding member 206 is a material made of a soft and elastic material of a high optical transmittance, and as shown in FIG. 15A, is provided extending from a portion where it faces the light emitting body 203 to another portion.

To be more specific, one end part 206*a* of the light guiding member 206 is protruded downward toward the light emitting body 203, and the other end 026*b* is protruded upward. A portion 206*c* between those ends, viz., most the light guiding member, is embedded in the sheet body 205. In this case, the upper surface and the lower surface of the light guiding member 206 are exposed from the sheet body 205. The light guiding member 206 is embedded by a two-color molding process in which a material of the light guiding member 206 and a material of the sheet body 205 are both injected into a forming mold and in this state, those are molded, or an insert molding process in which a light guiding member 206 already molded is set in a forming mold, and a material of the sheet body 205 is injected into the forming mold.

The light guiding member 206 is integral with the sheet body 205, and a light guiding path 210 defined by the light guiding member is formed in the sheet body (FIGS. 15A and 16).

In FIG. 17, reference numeral 211 indicates, for example, an operation knob having a light transmitting display section 212 serving as a light emission portion, which is disposed above the other end 206*b* of the light guiding member 206.

With such a structure, light emitted from the light emitting body 203 is led from the one end part 206*a* of the light guiding member 206 to the portion 206*c* extending to the other end 206*b*, viz., to the light guiding path 210, and is emitted from the other end 206*b* and illuminates the light transmitting display section 212.

Thus, in the switch-device sheet 204, the sheet body 205 is made of a soft and elastic material and has operation parts 207 for operating contacts of the switch device, and the light guiding member 206 is provided. The light guiding member 206 is made of a soft and elastic material having a high optical transmittance. The light guiding member is integral with the sheet body 205, and the light guiding path 210 is formed in the sheet body.

With such a construction, the light guiding member 206 is flexible. Accordingly, with the flexible feature of the sheet body 205, the whole switch-device sheet 204 is flexible. The switch-device sheet can be attached not only to the flat plane portion but also to the curved portion.

The light guiding member 206 may be arranged such that the portion 206*c* defining the light guiding path 210 is entirely covered with the sheet body 205, or a part of it is partially exposed and light is emitted from the exposed part.

It should be understood that the present invention is not limited to the illustrated embodiment, but may variously be modified, altered and changed within the true spirits and scope of the invention.

The light guiding member may be covered with a surface region of the switch-device sheet 204, and embedded in the switch-device sheet 204. In this construction, light which will leaks from the light guiding member when it travels through the light guiding member is lessened in amount (see FIG. 15B).

As seen from the foregoing description, a switch-device sheet of the invention is flexible as a whole, and may be attached not only to the flat plane portion but also the curved portion.

What is claimed is:

1. A light guiding device comprising:

a light guiding member made of a soft and elastic material of a high optical transmittance, a light being transmitted from one end of the light guiding member to the other end of the light guide member in a guiding direction; and a reflecting member including a reflecting surface colored to have a color of a high reflectivity, wherein the reflecting surface is pressed against a surface of the light guiding member which is substantially parallel to the guiding direction.

2. The light guiding device according to claim 1, wherein the light guiding member is attached to a contact sheet including a operation part, the reflecting member serves as a substrate including contact, and when the contact sheet is coupled to the substrate so as to face the operation part to the contact, the reflecting surface is pressed against the surface of the light guiding member.

* * * * *